United States Patent [19]

Fahey et al.

[11] Patent Number: 4,780,598

[45] Date of Patent: Oct. 25, 1988

[54] COMPOSITE CIRCUIT PROTECTION DEVICES

[75] Inventors: Timothy E. Fahey, San Jose; William D. Carlomagno, Redwood City; Andrew N. Au, Union City, all of Calif.

[73] Assignee: Raychem Corporation, Menlo Park, Calif.

[21] Appl. No.: 150,005

[22] Filed: Feb. 4, 1988

Related U.S. Application Data

[63] Continuation of Ser. No. 754,807, Jul. 12, 1985, abandoned, which is a continuation-in-part of Ser. No. 628,945, Jul. 10, 1984, abandoned.

[51] Int. Cl.[4] ..... H05B 1/02

[52] U.S. Cl. ..... 219/511; 219/505; 219/494; 219/491; 338/22 R; 361/103; 361/57

[58] Field of Search ..... 219/501, 511, 504, 505, 219/507–509, 490, 491, 494; 338/22 R, 22 SD, 25; 361/103, 106, 54, 58, 27, 57

[56] References Cited

U.S. PATENT DOCUMENTS

| | | | |
|---|---|---|---|
| 3,287,684 | 11/1966 | Armbruster | 219/549 X |
| 3,861,029 | 1/1975 | Smith-Johannsen et al. | 29/611 |
| 4,034,207 | 7/1977 | Tamada et al. | 338/22 SD X |
| 4,037,082 | 7/1977 | Tamada et al. | 219/541 |
| 4,051,550 | 9/1977 | Seno | 361/402 |
| 4,099,216 | 7/1978 | Weberg | 361/56 |
| 4,162,395 | 7/1979 | Kobayashi et al. | 219/504 X |
| 4,174,511 | 11/1979 | Knapp et al. | 219/511 |
| 4,177,446 | 12/1979 | Diaz | 338/212 |
| 4,177,785 | 12/1979 | Sundeen | 219/511 |
| 4,237,411 | 12/1980 | van Konynenburg et al. | 338/22 |
| 4,247,441 | 12/1980 | van Konynenburg | 338/22 R |
| 4,388,607 | 6/1983 | Toy et al. | 338/22 SD X |
| 4,413,174 | 11/1983 | Ting | 219/505 |
| 4,413,301 | 11/1983 | Middleman et al. | 219/505 |
| 4,426,339 | 1/1984 | Kamath et al. | 264/22 |
| 4,445,026 | 4/1984 | Walker | 219/553 |
| 4,467,310 | 8/1984 | Jakab | 338/22 |
| 4,481,498 | 11/1984 | McTavish et al. | 338/20 |
| 4,542,365 | 9/1985 | McTavish et al. | 338/20 |
| 4,549,161 | 10/1985 | McTavish et al. | 338/20 |

FOREIGN PATENT DOCUMENTS

| | | |
|---|---|---|
| 31283 | 7/1981 | European Pat. Off. . |
| 0038718 | 10/1981 | European Pat. Off. . |
| 0087884 | 9/1983 | European Pat. Off. . |
| 98647 | 1/1984 | European Pat. Off. . |
| 2434006 | 2/1976 | Fed. Rep. of Germany . |
| 2644256 | 3/1978 | Fed. Rep. of Germany . |
| 2825442 | 12/1979 | Fed. Rep. of Germany . |
| 2946842 | 5/1981 | Fed. Rep. of Germany . |
| 2528253 | 12/1983 | France . |

*Primary Examiner*—M. H. Paschall

*Attorney, Agent, or Firm*—Timothy H. P. Richardson; Herbert G. Burkard

[57] ABSTRACT

Circuit protection devices which comprise a PTC conductive polymer element and a second electrical component which is thermally coupled to the PTC element and which, when a fault causes the current in the circuit to become excessive, generates heat which is transferred to the PTC element, thus reducing the time taken to "trip" the PTC element. The second component is for example a voltage-dependent resistor which is connected in series with the PTC element under the fault conditions and is thus protected from damage.

27 Claims, 5 Drawing Sheets

COMPOSITE CIRCUIT PROTECTION DEVICES

CROSS-REFERENCE TO RELATED APPLICATION

This application is a file wrapper continuation of copending application Ser. No. 754,807, filed July 12, 1985, abandoned, which is itself a continuation-in-part of application Ser. No. 628,945, filed July 10, 1984 by William D. Carlomagno, now abandoned the entire disclosure of which is incorporated herein by reference.

BACKGROUND OF THE INVENTION

1. Field of the Invention

This invention relates to circuit protection devices comprising PTC conductive polymers.

2. Introduction to the Invention

Conductive polymer and ceramic compositions exhibiting PTC behavior, and electrical devices comprising them, are well known. Reference may be made, for example. to U.S. Pat. Nos. 2,952,761, 2,978,665, 3,243,753, 3,351,882, 3,571,777, 3,757,086, 3,793,716, 3,823,217, 3,858,144, 3,861,029, 3,950,604, 4,017,715, 4,068,281, 4,072,848, 4,085,286, 4,117,312, 4,177,376, 4,177,446, 4,188,276, 4,237,441, 4,242,573, 4,246,468, 4,250,400, 4,252,692, 4,255,698, 4,271,350, 4,272,471, 4,304,987, 4,309,596, 4,309,597, 4,314,230, 4,314,231, 4,315,237, 4,317,027, 4,318,881, 4,327,351, 4,330,704, 4,334,351, 4,352,083, 4,388,607, 4,398,084, 4,413,301, 4,425,397, 4,426,339, 4,426,633, 4,427,877, 4,435,639, 4,429,216, 4,442,139, 4,450,496 4,459,473, 4,459,632, 4,475,012, 4,481,498, 4,476,450 and 4,502,929, 4,514,620 and 4,515,449; J. Applied Polymer Science 19, 813–815 (1975), Klason and Kubat; Polymer Engineering and Science 18, 649–653 (1978), Narkis et al; and commonly assigned U.S. Ser. Nos. 601,424 (Moyer), now abandoned, published as German OLS No. 2,634,999; 750,149 (Kamath et al.), now abandoned, published as German OLS No. 2,755,077; 732,792 (Van Konynenburg et al), now abandoned, published as German OLS No. 2,746,602; 798,154 (Horsma et al), now abandoned, published as German OLS No. 2,821,799; 134,354 (Lutz); 141,984 (Gotcher et al.), published as European Application No. 38718; 141,988 (Fouts et al.), published as European Application No. 38,718, 141,989 (Evans), published as European Application No. 38,713, 141,991 (Fouts et al.), published as European Application No. 38,714, 150,909 (Sopory), published as UK Application No. 2,076,106A, 184,647 (Lutz), 250,491 (Jacobs et al.) 272,854 (Steward et al), published as European Patent Application No. 67,679, 274,010 (Walty et al.), 300,709 and 423,589 (van Konynenburg et al.), published as European Application No. 74,281, 369,309 (Midgley et al.), 483,633 (Wasley), 509,897 and 598,048 (Masia et al.), 524,482 (Tomlinson et al), 534,913 (McKinley), 552,649 (Jensen et al), 573,099 (Batliwalla et al), 904,736, published as UK Pat. Nos. 1,470,502 and 1,470,503, 628,945 (Carlomagno), and 650,918, 650,920 and 650,919 (Batliwalla et al), 716,790 (Carlomagno), 711,908 (Ratell), 711,909 (Deep et al), 711,910 (Au et al) and 711,907 (Ratell). The disclosure of each of the patents, publications and applications to above is incorporated herein by reference.

Particularly useful devices comprising PTC conductive polymers are circuit protection devices. Such devices have a relatively low resistance under the normal operating conditions of the circuit, but are "tripped", i.e., converted into a high resistance state, when a fault condition, e.g., excessive current or temperature, occurs. When the device is tripped by excessive current, the current passing through the PTC element causes it to self heat to an elevated temperature at which it is in a high resistance state. Such devices, and PTC conductive polymer compositions for use in them, are described for example in U.S. Pat. Nos. 4,237,411, 4,238,812; 4,255,698; 4,315,237; 4,317,027; 4.329,726; 4,352,083; 4,413,301; 4,450,496; 4,475,138; 4,481,498; 4,534,889 and 4,562,313 and in copending commonly assigned U.S. application Ser. Nos. 141,989, 711,790 now U.S. Pat. No. 4,685,025, 711,908 now U.S. Pat. No. 4,647,896, 711,909, 711,910, and 711,907 now U.S. Pat. No. 4,647,894. The disclosure of each of these patents and pending applications is incorporated herein by reference.

A particularly important use for circuit protection devices is in telecommunications apparatus, which can be exposed to a variety of different fault conditions. Reference may be made for example to U.S. Pat. Nos. 4,068,277, 4,068,281, 4,475,012, 4,459,632 and 4,562,313. Application Nos. 711,790, 711,907, 711,908, 711,909 and 711,910, the disclosures of which are incorporated hereby by reference.

SUMMARY OF THE INVENTION

We have now discovered that improved protection of circuits against excessive currents (and the voltages which produce such currents) can be obtained through the use of composite protection devices which comprise a PTC conductive polymer element and a second electrical component which, under at least some of the fault conditions against which protection is needed, modifies the response of the PTC element to the fault conditions in a desired way. For example, the second component may be a resistor which, under the fault conditions, generates heat which is transferred to the PTC element and thus reduces the "trip time" of the device (i.e. the time taken to convert the PTC element into a high resistance, high temperature state such that the circuit current is reduced to a safe level). The second component may function substantially only to reduce the trip time, but it is preferably part of the circuit protection system. The reduction of the current by the PTC element may serve to protect the second component and/or to protect other components of the circuit.

The use of PTC conductive polymer in such devices offers very important advantages over the use of a PTC ceramic. For example many PTC conductive polymers are known whose resistivity does not decrease over a temperature range between the switching temperature ($T_S$) and a much higher temperature, e.g. ($T_S$+40)° C., so that by using such conductive polymers, one can eliminate any danger that the additional heat supplied by the second electrical component will cause the PTC element to reach a temperature which is so far above $T_S$ that the composition shows NTC behavior (i.e. its resistivity decreases with an increase in temperature). PTC ceramics, on the other hand, become NTC at a temperature which is not far above, e.g. 20° to 50° C. above, their $T_S$. Another major disadvantage of PTC ceramics is that they are difficult or impossible to form into complex shapes (typically they are formed only into simple plates); this limits their ability to be shaped into conformity with the second component and to provide efficient heat-sinking of the second component. In addition, ceramics are brittle, and this tends to make them crack when they are subjected to the thermal-electrical-mechanical stresses created by "tripping" of a device in which a second component increases the rate at which the temperature of the PTC element increases. PTC conductive polymers, by contrast, can readily be shaped in almost any desired shape by a variety of techniques, e.g. molding, extrusion and sintering and are much better able to withstand thermal-electrical-mechanical stresses than PTC ceramics. Another disadvantage of PTC ceramics, in many cases, is that their resistivity is higher than is desirable.

In one preferred embodiment of the invention, there is provided an electrical apparatus which comprises (1) a first electrical component comprising (a) a PTC element composed of a conductive polymer which exhibits PTC behavior with a switching temperature $T_s$ and which has a resistivity which does not decrease in the temperature rante $T_s$ to $(T_s+20)°$ C.; and (b) at least two electrodes which can be connected to a source of electrical power so that current passes between the electrodes through the PTC element;

(2) a second electrical component which (a) is physically adjacent to and physically connected to the first component so that it is in good thermal contact with the PTC element, but which is not in direct physical and electrical contact with the first component; and (b) is electrically connected to the first component;

(3) an electrical lead which electrically connects the first and second electrical components; and (4) an electrically insulating component which lies between the first and second electrical components;

the apparatus being suitable for use in an electrical circuit in which, under normal operating conditions, the PTC element is in a low temperature, low resistance state and which, if it is subject to a fault condition which results in excessive current in the circuit, is protected from damage by conversion of the PTC element into a high resistance, high temperature state which reduces the current to a safe level, the second component, when subject to the fault condition, generating heat which is transferred to the PTC element and reduces the time taken to convert the PTC element to the high resistance, high temperature state.

A preferred process for making apparatus as described above comprises (1) placing within a mold a device comprising an electrical component, an electrically insulating component surrounding the electrical component, and two electrical leads extending from the electrical component through the insulating component; and (2) filling the mold with a conductive polymer which exhibits PTC behavior with a switching temperature ($T_s$) and which has a resistivity which does not decrease in the temperature range ($T_s$) to $(T_s+20)°$ C., thereby contacting the conductive polymer with at least one of said electrical leads which thus provides at least one of said electrodes.

Another method of making such apparatus is to mold, e.g. injection mold, the PTC polymer into a suitable shape having one or more cavities therein to receive one or more second components, and then to insert the second component(s) into the cavity(ies). The electrodes can be molded into the PTC element, or secured to the PTC element before or after the second component(s) has (have) been inserted, or secured to the second component(s) before the latter are inserted into the PTC element.

In another preferred embodiment, the invention provides a circuit protection device which comprises (a) a PTC element composed of a first conductive polymer exhibiting PTC behavior;

(b) a ZTC element composed of a second conductive polymer which exhibits ZTC behavior and which has a resistivity at 23° C. which is greater than the resistivity at 23° C. of the first conductive polymer, the ZTC element being in direct physical and electrical contact with the PTC element; and (c) at least two electrodes which can be connected to a source of electrical power;

the components (a), (b) and (c) being so arranged that when the electrodes are connected to a power source such that the PTC element is converted into a high temperature high resistance state, (1) all current paths between the electrodes pass through the PTC element and the ZTC element, and (2) a hot zone is formed at an interface between the PTC and ZTC elements and at a location on the interface which is completely surrounded by the PTC and ZTC elements.

The invention further includes electrical circuits which comprise a source of electrical power, a load and a circuit protection apparatus or device as defined above. In such circuits, the first and second electrical components can be connected in series both under the normal operating conditions of the circuit and under the fault conditions (as for example when the second component is a surge resistor in a telephone circuit), or the second component can be one through which no current passes under normal operating conditions but is placed in series with the first component under the fault conditions (as for example when the second component is a VDR which is connected to ground to provide a clampdown in a telephone circuit).

The first electrical component which is used in conjunction with a second electrical component in the first embodiment of the invention is in itself a circuit protection device. One of the first electrical components which can be used in the first embodiment of the invention comprises a laminar element of a PTC conductive polymer and a plurality of electrodes which are dimensioned and positioned so that when current passes between the electrodes, a substantial proportion of the current is parallel to the faces of the laminar element. Preferably the electrodes are interdigitated electrodes on the same surface of the laminar PTC element. Such first electrical components are in themselves novel and useful as circuit protection devices, whether used with or without a second component as defined, and in another aspect the present invention includes an electrical circuit comprising (A) a power source;

(B) an electrical load; and (C) a circuit protection device which is in series with the load and which comprises (1) a laminar element which is at least 0.002 inch thick and is composed of a conductive polymer composition which (a) exhibits PTC behavior and (b) comprises an organic polymer and, dispersed in the polymer, a particulate conductive filler; and (2) a plurality of electrodes, at least two of which are connected to the power source to cause current to pass through the laminar element, and which are dimensioned and positioned so that (a) a substantial proportion of the current which passes between the electrodes is parallel to the faces of the laminar element, and (b) the ratio of the average width of the electrodes, measured parallel to the faces of the laminar element, to the average distance between adjacent electrodes between which current passes, measured parallel to the faces of the laminar element, is at least 0.1:1;

said circuit having a normal operating condition in which the PTC conductive polymer composition of the circuit protection device is in its low temperature, low resistivity state.

BRIEF SUMMARY OF THE DRAWING

The invention is illustrated in the accompanying drawing, in which.

DETAILED DESCRIPTION OF THE INVENTION

Figure 1:
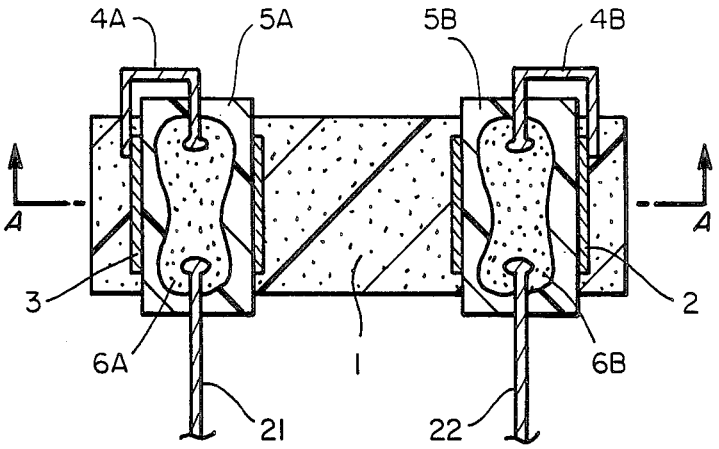
FIG. 1 is a cross-section through an apparatus of the invention.

In the first embodiment of the invention, the second electrical component can be one which is specially designed for the particular performance characteristic required; for example, it can be composed of a ZTC conductive polymer. However, a particular advantage of this embodiment is that it can make use of standard commercially available electrical components as the second electrical component, or at least can make use of standard production techniques to produce suitable second electrical components. In this way, for example, it is possible to make use of a component which has a recognized utility as part of a circuit, eg. a voltage-dependent resistor (VDR) such as a varistor, a transistor, or another electronic component or a resistor whose resistance is comparatively independent of voltage. The second component can, for example, be a resistor which is a thick film resistor, a thin film resistor, a metallic film resistor, a carbon resistor, a metal wire, or a conductive polymer resistor formed by, for example, melt-shaping (including melt-extrusion, transfer molding and injection molding), solution-shaping (including printing and casting), sintering or any other suitable technique. The resistance of resistors produced by some of these techniques can be changed by laser-trimming techniques. The resistance of the resistor at 23° C. is preferably at least 2 times, particularly at least 5 times, especially at least 10 times or even higher, eg. at least 20 times, the resistance at 23° C. of the PTC element. The resistance of the resistor preferably does not increase substantially with temperature. The preferred total resistance at 23° C. of the first and second components together will depend on the end use, and may be for example 3 to 2000 ohms, eg. 5 to 1500 ohms, but is usually 5 to 200 ohms, with the resistance of the PTC element being for example 1 to 100 ohms, usually 1 to 5 ohms.

There can be two or more second electrical components, which can be the same or different.

The leads which are secured to the second electrical component can function not only to connect the component to the circuit and to the first component, but can also be used to provide the electrodes of the first component. For example, one of the leads can be wrapped around an insulating member which surrounds the first component, and the PTC polymer can be molded around the wrapped product. Alternatively or additionally one or both of the leads can be bent into a suitable configuration around, but not touching, an insulating member which surrounds the first component, and the PTC polymer can be molded around the product. These expedients result in apparatus in which the lead between the first and second components and one of the electrodes are formed by a single piece of metal. The cross-section of the leads can, if desired, be modified to provide a desired electrode configuration, eg. a planar or curved laminar cross-section instead of a round cross-section. It is also possible to change the cross-section of a part of the lead which is not to be molded into the PTC polymer in order to provide a fuse link which will provide protection against a fault condition which cannot otherwise be taken care of by the apparatus. By making use of the leads to provide electrodes in this way, considerable advantages can be obtained in the injection molding process which is preferably used to shape the PTC conductive polymer around the second component and the electrodes. Thus the leads help to stabilize the configuration inside the mold. If desired, one or more of the leads can be arranged so as to pass through the mold at spaced apart locations and can be severed, after molding is complete, to provide a desired electrical arrangement.

Suitable PTC conductive polymers for use in this invention are disclosed in the prior art, eg. the documents incorporated by reference herein. The conductive polymer should have a resistivity which does not decrease in the temperature range $T_s$ to $(T_s+20)$° C., preferably $T_s$ to $(T_s+40)$° C., particularly $T_s$ to $(T_s+75)$° C.

The insulating element which lies between the first and second components is subject to substantial thermo-mechanical stress and should be selected accordingly.

In one preferred embodiment, the insulating element comprises a metal surrounded by an insulating material, eg. anodized aluminum, in order to improve heat transfer from the second component to the PTC element; such an insulating element can be shaped so that it extends into the PTC element and thus delivers heat to a desired location for the hot zone between the electrodes. The use of an insulating element of this kind is particularly valuable when the second component is in the form of a disc or other shape which cannot easily be fitted within the PTC element.

The first and second electrical components are preferably arranged so that the thermal gradient induced in the PTC element is at right angles to the direction of current flow in the PTC element. This is important because the heat flow can otherwise encourage formation of the hot zone adjacent one of the electrodes, which is undesirable. When the second electrical component lies in a cavity in the PTC element between the electrodes, the desired result is usually easy to obtain. However, if the second component is flat, conventional arrangements of the electrodes and the PTC element encourage formation of the hot zone adjacent one of the electrodes. Particularly in this situation, therefore, the first electrical component preferably comprises the novel combination of interdigitated electrodes positioned on a surface of a laminar PTC element, as described in detail in the parent application Ser. No. 628,945 incorporated by reference herein. Such a first electrical component can also be wrapped around a cylindrical second component, eg. a carbon resistor.

In the second embodiment of the invention, the PTC and ZTC conductive polymer elements are in direct contact with each other. As in earlier devices of this kind, the hot zone forms at the interface between the PTC and ZTC elements, but in the devices of the present invention the elements are arranged so that the hot zone is confined to that part of the interface which is completely surrounded by the PTC and ZTC elements. It had not previously been realized that this was important because the presence of air at the hot zone increases the probability of breakdown. Preferably each of the electrodes is in the form of a columnar member (eg. a wire) having an enlarged head (eg. a disc or a sphere or a loop in the member) to reduce the current density on the electrode. Preferably, the enlarged head of at least one of the electrodes is embedded in a ZTC element which is substantially surrounded by the PTC element.

DETAILED DESCRIPTION OF THE CIRCUIT PROTECTION DEVICES COMPRISING INTERDIGITATED ELECTRODES

It is to be understood that the device of this aspect of the invention can be part of a larger device which does not meet the definition given above. Thus this aspect of the invention includes for example a device which comprises (1) a laminar element as defined above and (2) electrodes which in one or more areas are as defined above in one or more areas fail to meet the definition given above, e.g. because the electrodes are too far apart.

The laminar element is composed of a PTC conductive polymer composition. Many such compositions are described in the various patents, patent applications and publications referred to above and incorporated by reference herein. Preferred compositions comprise carbon black, or a mixture of carbon black and graphite, as the conductive filler. The composition can also contain a non-conductive filler, which may be reinforcing or non-reinforcing, and/or a filler exhibiting non-linear properties. One or more of the fillers can be selected to have a high thermal conductivity.

The polymer preferably comprises at least one thermoplastic crystalline polymer. Particularly useful polymers are olefin polymers, incuding homopolymers, particularly polyethylene; copolymers of two or more olefins; and copolymers of one or more olefins, e.g. ethylene or propylene, with one or more olefinically unsaturated comonomers, preferably polar comonomers, e.g. vinyl acetate, acrylic acid methyl acrylate and ethyl acrylate. Also useful are fluoropolymers (which may be olefin polymers), eg. polyvinylidene fluoride and copolymers of ethylene with tetrafluoroethylene and/or a perfluoroalkoxy comonomer. Mixtures of polymers can be used, including mixtures of thermoplastic and amorphous, e.g. elastomeric, polymers. The conductive polymer can be cross-linked, preferably by irradiation, after it has been shaped, or while it is being shaped, into the laminar element.

The preferred resistivity of the conductive polymer at room temperature (23° C.) will depend upon the desired characteristics of the device, but will generally be in the range from 0.5 to 100,000 ohm.cm, preferably 1.0 to 100 ohm.cm. The resistance of the device at 23° C. is preferably from 1 to 1,000, especially from 2 to 100 ohms.

The polymer is preferably melt-shaped, with melt-extrusion usually being preferred. When the melt-shaping method results in a preferred orientation of the conductive particles (as does melt-extrusion), the electrodes are preferably arranged so that current flow between them predominantly follows (e.g. is at an angle of not more than 30°, preferably not more than 15°, to) the direction of orientation (which, in the case of melt-extrusion, is the direction of extrusion).

The laminar element can be very thin, but generally has a thickness of at least 0.002 inch, preferably at least 0.008 inch, particularly at least 0.01 inch. There is no upper limit on the thickness of the laminar element, but the thickness of the element is generally not more than 0.25 inch, and when the electrodes are applied to a surface of the element, is usually not more 0.1 inch, preferably not more than 0.05 inch, particularly not more than 0.025 inch.

An important feature of this aspect of the present invention is the size and spacing of the electrodes. The electrodes are preferably ribbon-shaped elements secured on the same side of the laminar element, as is preferred, or on opposite sides of the element. It is also possible for ribbon-shaped electrodes to be placed on both surfaces of the conductive polymer element, usually as mirror images to ensure the desired direction of current flow. It is also possible for the electrodes to be within the thickness of the conductive polymer element, e.g. by sandwiching the electrodes between two conductive polymer elements, which can be the same or different.

The electrodes can be secured in or on the laminar element in any convenient way, for example by means of pre-shaped foil electrodes, by printing a conductive ink onto the laminar element to form the electrodes, through the use of polymer thick film technology, or by sputtering, or by a process comprising an etching step. The electrodes can also be formed on a surface of an insulating laminar element, for example by the techniques noted above or by etching, and the conductive polymer can then be secured to the electrodes and the insulating laminar element, for example by laminating a pre-formed film of the conductive polymer to the insulating element. Suitable materials for the electrodes include metals and metal alloys, for example silver, copper, ruthenium, gold and nickel. Electrodes comprising graphite can also be used.

The ratio of the average width of the electrodes, measured parallel to the faces of the laminar element, to the average distance between adjacent electrodes between which current passes, measured parallel to the faces of the laminar element, is at least 0.1:1, preferably at least 0.25:1, particularly at least 0.4:1, especially at least 0.5:1, with a preferred upper limit of less than 10:1, particularly less than 5:1, especially less than 3:1. The electrodes can be equally spaced from each other. However, variation of the distance between the electrodes is possible, and can produce valuable effects on the dynamics of the tripping of the device. Preferably the electrodes are so positioned and dimensioned that, at all points, the distance between adjacent electrodes between which current passes, measured parallel to the faces of the laminar element, is not more than ten times, preferably not more than six times, especially not more than three times the average distance between adjacent electrodes between which current passes, measured parallel to the faces of the laminar element. The total surface area of the electrodes, viewed at right angles to the laminar element, to the surface area of one of the faces of the laminar element is preferably at least 0.1:1, particularly at least 0.25:1, especially at least 0.5:1.

Preferred patterns for the electrodes include interdigitating comb-like patterns of opposite polarities; a central backbone of one polarity with two comb-like patterns which interdigitate with the fingers on opposite sides of the backbone and which both have a polarity opposite to the central backbone; and a central backbone with two comb-like patterns which interdigitate with the fingers on opposite sides of the backbone and which are of opposite polarity to each other, with the backbone being at an intermediate voltage when a DC power supply is used or providing a neutral (which may be a floating neutral) when an AC power supply is used.

The electrodes can be quite thin, and when this is so, the device will usually comprise bus connectors for the electrodes, thus ensuring that there is substantially no resistive heating of the electrodes in the normal operating condition of the circuit. These connectors will generally be straight strips of metal which run up one margin, or up a center line, of the heater. The connectors can be added after the electrodes have been applied, or they can be secured to the laminar element and the electrodes applied over both.

The devices of this asect of the invention can comprise laminar insulating elements covering the conductive element and electrodes, or can comprise a container which is spaced apart from the conductive element and electrodes in order to provide both physical and electrical protection; and if desired, to exclude oxygen.

Referring now to the drawing, each of FIGS. 1, 2, 4, 5, 6, 7, 8 and 10 shows a PTC element 1 which is contacted by electrodes 2 and 3; a lead 4 (leads 4A and 4B in FIG. 1) which connects one of the electrodes to a second electrical component which is a resistor 6 (6A, 6B in FIG. 1); an insulating member 5 (5A, 5B in FIG. 1); and leads 21 and 22 for connecting the device into a circuit.

Figure 2:
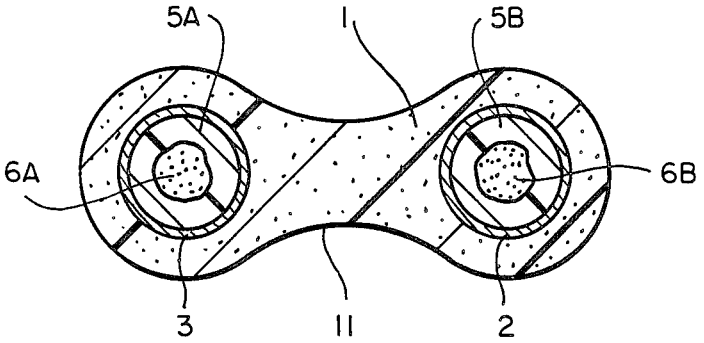
FIG. 2 is a cross-section on line A,A of FIG. 1.
Figure 3:
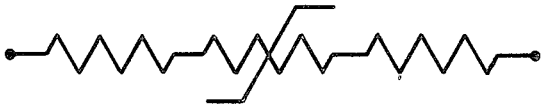
FIG. 3 is the equivalent circuit of the apparatus shown in FIGS. 1 and 2.
Figure 4:
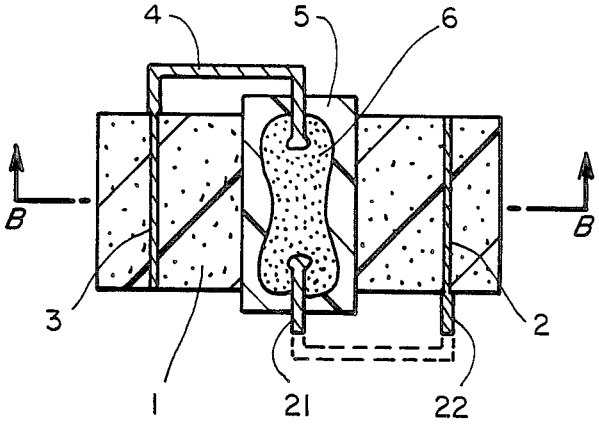
FIG. 4 is a cross-section through a second apparatus of the invention.
Figure 5:
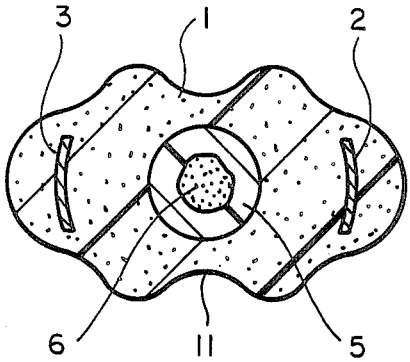
FIG. 5 is a cross-section on line B,B of FIG. 4.
Figure 9:
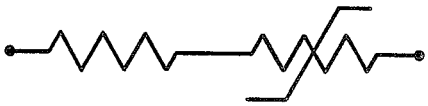
FIG. 9 is the equivalent circuit of the apparatus shown in FIGS. 4 to 8.
Figure 6:
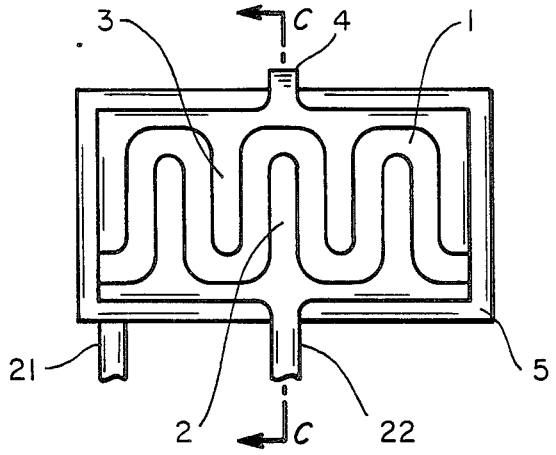
FIG. 6 is a plan view of a third apparatus of the invention.
Figure 7:
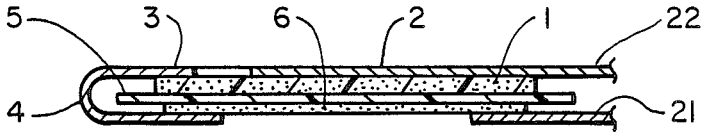
FIG. 7 is a cross-section on line C,C of FIG. 6.
Figure 8:
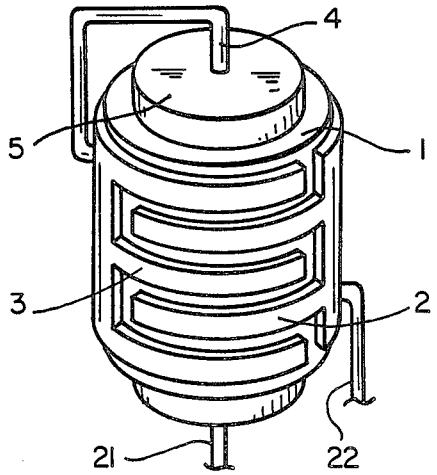
FIG. 8 is an isometric drawing of a fourth apparatus of the invention.
Figure 10:
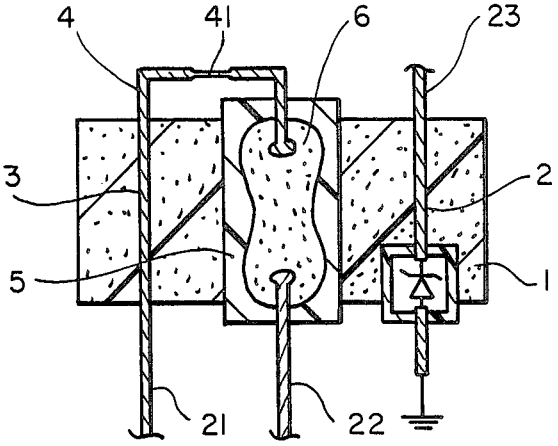
FIG. 10 is a cross-section through a fourth apparatus of the invention.
Figure 11:
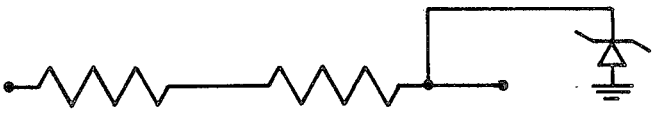
FIG. 11 is the equivalent circuit of the apparatus shown in FIG. 10.

In FIGS. 1 and 2, one lead of each of two carbon resistors is wrapped around the insulating container of the resistor to provide one of the electrodes which contact the PTC element. In FIGS. 4 and 5, each of leads from a carbon resistor has been modified into a desired electrode shape and then embedded in the PTC element; the dotted lines in FIG. 4 show where one of the leads was severed, after molding was complete, to provide the desired configuration. FIG. 6 and 7 show a first component which comprises interdigitated electrodes secured to a laminar PTC element and which is secured to a flat resistor. FIG. 8 shows a similar first component wrapped around a cylindrical resistor. FIG. 10 shows an apparatus which comprises two second components, one a resistor, the other a VDR.

Figure 12:
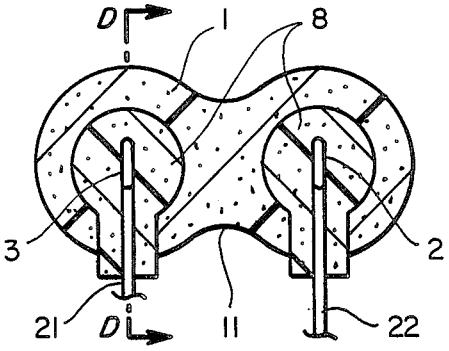
FIG. 12 is a cross-section through a device of the invention.
Figure 13:
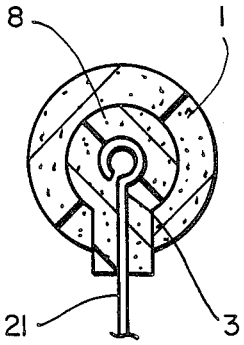
FIG. 13 is a cross-section on line D,D of FIG. 12.

FIGS. 12 and 13 illustrate the second embodiment of the invention and show electrodes 2 and 3 with enlarged heads which are embedded in ZTC conductive polymer elements 8 which are in turn embedded in a PTC conductive polymer element 1.

As shown in FIGS. 2, 5 and 12, the PTC conductive polymer element is preferably shaped with a construction 11 to promote formation of the hot zone at a location midway between the electrodes.

Figure 14:
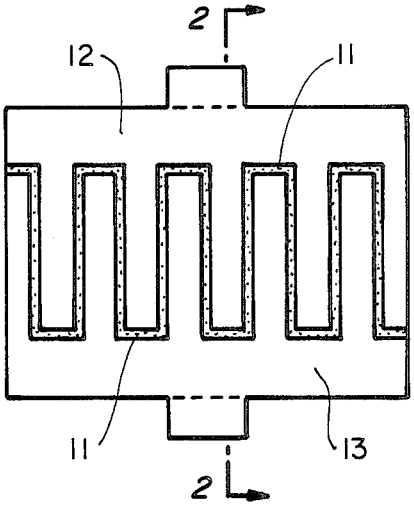
FIG. 14 is a plan view of a circuit protection device comprising interdigitated electrodes on a surface of a PTC element.
Figure 15:
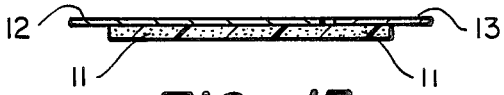
FIG. 15 is a cross-section taken on line 2—2 of FIG. 1.
Figure 16:
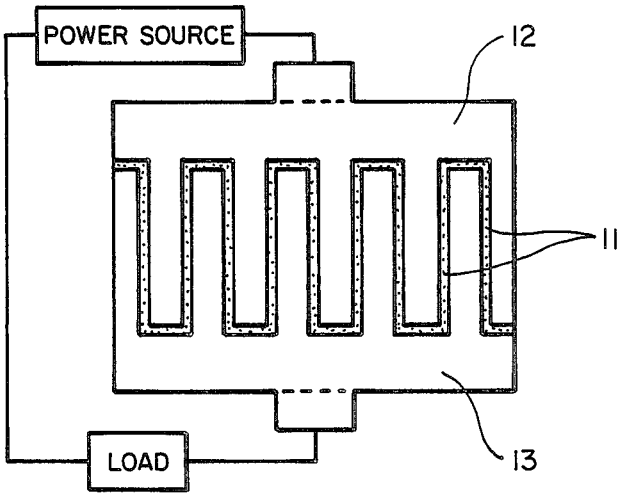
FIG. 16 is a diagram of a circuit including the device of FIGS. 14 and 15, a power source and a load.

Referring now to FIGS. 14 and 15, a laminar PTC conductive polymer element 11 carries on one surface thereof interdigitating comb-like electrodes 12 and 13.

The invention is further illustrated by the following Example.

EXAMPLE

A circuit protection device as illustrated in FIGS. 14 and 15 was made as follows. A piece of aluminum foil, 0.002 inch thick, was cut into two electrodes of the shape shown in FIG. 14, which were then secured to one face of a sheet of conductive polymer, $1.25 \times 1.75 \times 0.020$ inch in dimensions, by heating the foil electrodes and the conductive polymer sheet to 180°–200° C. in a nitrogen gas environment and applying pressure. The conductive polymer had a resistivity of about 4 ohm.cm at room temperature and comprised Statex G carbon black dispersed in Marlex 6003 (a high density polyethylene sold by Philips). The composition was converted into a sheet by extrusion.

The device, which has a resistance at room temperature of about 1 ohm, was tested by connecting it in series with a 80 volt AC power source and a load resistance of about 25 ohms, which resulted in an initial current of about 3.0 amp passing through the device. In about 5 seconds, the resistance of the device rose to about 210 ohms, thus reducing the current to about 0.380 amps.

We claim:

1. Electrical apparatus which comprises (1) a first electrical component comprising (a) a PTC element composed of a conductive polymer which exhibits PTC behavior with a switching temperature $T_s$ and which has a resistivity which does not decrease in the temperature range $T_s$ to $(T_s+20)$° C.; and (b) at least two electrodes which can be connected to a source of electrical power so that current passes between the electrodes through the PTC element;

(2) a second electrical component which (a) is physically adjacent to and physically connected to the first component so that it is in good thermal contact with the PTC element, but which is not in direct physical contact with the first component; and (b) is electrically connected to the first component;

(3) an electrical lead which electrically connects the first and second electrical components; and (4) an electrically insulating component which is composed of a solid material, which lies between the first and second electrical components and which is in direct physical contact with the first electrical component and with the second electrical component;

the apparatus being suitable for use in an electrical circuit in which, under normal operating conditions, the PTC element is in a lower temperature, low resistance state and which, if it is subject to a fault condition which results in excessive current in the circuit, is protected from damage by conversion of the PTC element into a high resistance, high temperature state which reduces the current to a safe level, the second component, when subjected to the fault condition, generating heat which is tranferred to the PTC element and reduces the time taken to convert the PTC element to the high resistance, high temperature state.

2. Apparatus according to claim 1 wherein the thermal gradient induced in the PTC element by heat transferred from the second component is at right angles to the direction of curent flow in the PTC element.

3. Apparatus according to claim 1 wherein the second component is a resistor selected from thick film resistors, thin film resistors, metallic film resistors, carbon resistors, wire resistors, and conductive polymer resistors.

4. Apparatus according to claim 3 wherein the second component has a resistance at 23° C. which is at least 2 times the resistance at 23° C. of the first component and which does not increase substantially with temperature.

5. Apparatus according to claim 1 wherein the second component has a voltage-dependent resistance.

6. Apparatus according to claim 1 wherein the second component is a varistor, a transistor, or another electronic component.

7. Apparatus according to claim 1 which comprises two second electrical components, one being a voltage-dependent resistor and the other being a resistor whose resistance is substantially independent of voltage.

8. Apparatus according to claim 1 wherein the electrically insulating component is composed of a solid material, and the second component and the electrically insulating component are substantially surrounded by the PTC element.

9. Apparatus according to claim 1 wherein the electrical lead and one of the electrodes are provided by a single piece of metal.

10. Apparatus according to claim 1 wherein the first electrical component comprises interdigitated electrodes positioned on a surface of a laminar PTC element.

11. Apparatus according to claim 1 wherein the first component comprises two electrodes which are in direct physical and electrical contact with the PTC element, and there is at least one second electrical component which lies between the electrodes in a cavity in the PTC element.

12. Apparatus according to claim 1 wherein the insulating component comprises a metal member substantially surrounded by an insulating member and extends into the PTC element between the electrodes.

13. Apparatus according to claim 12 wherein the insulating component comprises anodized aluminum.

14. An electrical circuit which comprises (A) a source of electrical power;

(B) an electrical load; and (C) electrical apparatus to protect the circuit from damage under a fault condition, said apparatus comprising (1) a first electrical component comprising (a) a PTC element composed of a conductive polymer which exhibits PTC behavior with a switching temperature $T_s$ and which has a resistivity which does not decrease in the temperature range $T_s$ to $(T_s+20)$° C.; and (b) at least two electrodes which can be connected to a source of electrical power so that current passes between the electrodes through the PTC element;

(2) a second electrical component which (a) is physically adjacent to and physically connected to the first component so that it is in good thermal contact with the PTC element, but which is not in direct physical contact with the first component; and (b) is electrically connected to the first component;

(3) an electrical lead which electrically connects the first and second electrical components; and (4) an electrically insulating component which is composed of a solid material, which lies between the first and second electrical components, and which is in direct physical contact with the first electrical component and with the second electrical component;

said circuit having normal operating condition in which the PTC element is in a low temperature, low resistance state, and said circuit being liable to exposure to at least one fault condition in which damage to one or more components of the circuit is prevented by conversion of the PTC element into a high temperature, high resistance state which reduces the current to a safe level, the second component, when subject to the fault condition, generating heat which is transferred to the PTC element and reduces the time taken to convert the PTC element into the high resistance, high temperature state.

15. A process for the preparation of an electrical apparatus which comprises (1) a first electrical component comprising (a) a PTC element composed of a conductive polymer which exhibits PTC behavior with a switching temperature $T_s$ and which has a resistivity which does not decrease in the temperature range $T_s$ to $(T_s+20)$° C.; and (b) at least two electrodes which can be connected to a source of electrical power so that current passes between the electrodes through the PTC element;

(2) a second electrical component which (a) is physically adjacent to and physically connected to the first component so that it is in good thermal contact with the PTC element, but which is not in direct physical contact with the first component; and (b) is electrically connected to the first component;

(3) an electrical lead which electrically connects the first and second electrical components; and (4) an electrically insulating component which is composed of a solid material, which lies between the first and second electrical components, and which is in direct physical contact with the first component and with the second component;

which process comprises (1) placing within a mold a device comprising said second electrical component, an electrically insulating component surrounding said second electrical component, and two electrical leads extending from said second electrical component through the insulating component; and (2) filling the mold with a conductive polymer which exhibits PTC behavior with a switching temperature ($T_s$) and which has a resistivity which does not decrease in the temperature range ($T_s$) to ($T_s$+20)° C., thereby contacting the conductive polymer with at least one of said electrical leads which thus provides at least one of said electrodes.

16. A process according to claim 15 wherein one of the leads passes through the mold at two spaced apart locations and the process includes severing said lead between said locations, whereby said lead provides both said electrodes.

17. A process according to claim 15 wherein two said devices are placed within the mold and said electrodes are provided by one lead from each of said devices.

18. A circuit protection device which comprises (a) a PTC element composed of a first conductive polymer exhibiting PTC behavior;

(b) a ZTC element composed of a second conductive polymer which exhibits ZTC behavior and which has a resistivity at 23° C. which is greater than the resistivity at 23° C. of the first conductive polymer, the ZTC element being in direct physical and electrical contact with the PTC element; and (c) at least two electrodes which can be connected to a source of electrical power;

the components (a), (b) and (c) being so arranged that when the electrodes are connected to a power source such that the PTC element is converted into a high temperature high resistance state, (a) all current paths between the electrodes pass through the PTC element and the ZTC element, and (2) a hot zone is formed at an interface between the PTC and ZTC elements and at a location on the interface which is completely surrounded by the PTC and ZTC elements.

19. A device according to claim 18 wherein each of said electrodes is in the form of a columnar member having an enlarged head, and the enlarged head of at least one of said electrodes is embedded in a ZTC element which is substantially surrounded by the PTC element.

20. A device according to claim 19 wherein the head of each of said electrodes is embedded in a ZTC element, and the PTC element substantially surrounds both ZTC elements.

21. A circuit according to claim 14 wherein no current passes through the second component under normal operating conditions and the second component is in series with the first component under the fault condition.

22. An electrical circuit comprising (A) a power source;

(B) an electrical load; and (C) a circuit protection device which is in series with the load and which comprises (1) a laminar element which is at least 0.002 inch thick and is composed of a conductive polymer composition which (a) exhibits PTC behavior and (b) comprises an organic polymer and, dispersed in the polymer, a particulate conductive filler; and (2) a plurality of spaced-apart electrodes, at least two of which are connected to the power source to cause current to pass between the electrodes through the laminar element, each electrode comprising a plurality of distinct parts which interdigitate with distinct parts of an adjacent electrode and which are dimensioned and positioned so that (a) when current passes between the electrodes, a substantial proportion of the current through the laminar element is parallel to the faces of the laminar element, and (b) the ratio of the average width of the electrodes, measured parallel to the faces of the laminar element and in the direction of current flow in the laminar element, to the average distance between adjacent electrodes between which current passes, measured parallel to the faces of the laminar element and in the direction of current flow in the laminar element, is at least 0.1:1;

said circuit having a normal operating condition in which the PTC conductive polymer composition of the circuit protection device is in its low temperature, low resistivity state.

23. A circuit according to claim 22 wherein the electrodes of the circuit protection device are interdigitated and are so positioned and dimensioned that, at all points, the distance between adjacent electrodes between which current passes, measured parallel to the faces of the laminar element, is not more than three times the average distance between adjacent electrodes between which current passes, measured parallel to the faces of the laminar element.

24. A circuit according to claim 22 wherein the conductive polymer composition of the circuit protection device has been melt-extruded and the electrodes are so positioned that current passing between the electrodes follows a path which is substantially parallel to the direction of extrusion.

25. A circuit according to claim 22 wherein the electrodes of the circuit protection device have been printed on the same surface of the laminar element.

26. A circuit according to claim 22 wherein in the circuit protection device the electrodes are interdigitated and the ratio of the average width of the electrodes to the average distance between adjacent electrodes between which current passes is from 0.4:1 to less than 5:1.

27. A circuit according to claim 22 wherein the conductive polymer composition of the circuit protection device has a resistivity at 23° C. of 1 to 100 ohm.cm and the circuit protection device has a resistance at 23° C. of 2 to 100 ohms.

* * * * *